US006478543B1

(12) United States Patent
Tuchscherer et al.

(10) Patent No.: US 6,478,543 B1
(45) Date of Patent: Nov. 12, 2002

(54) TORQUE TRANSMITTING DEVICE FOR MOUNTING A PROPELLER TO A PROPELLER SHAFT OF A MARINE PROPULSION SYSTEM

(75) Inventors: John A. Tuchscherer, Oshkosh, WI (US); Daniel J. Schlagenhaft, Fond du Lac, WI (US); Michael A. Karls, Hilbert, WI (US); Robert B. Weronke, Oshkosh, WI (US); Douglas A. Kiesling, West Bend, WI (US); Mitesh B. Sheth, Fond du Lac, WI (US); Donald F. Harry, Appleton, WI (US); Randall J. Poirier, Howards Grove, WI (US); Richard A. Davis, Mequon, WI (US)

(73) Assignee: Brunswick Corporation, Lake Forest ( * ) Notice: Subject to any disclaimer, the term of this patent is extended or adjusted under 35 U.S.C. 154(b) by 73 days.

(21) Appl. No.: 09/781,640

(22) Filed: Feb. 12, 2001

(51) Int. Cl.[7] ..... B63H 23/34
(52) U.S. Cl. ..... 416/134 R; 416/93 A
(58) Field of Search ..... 416/93 A, 134 R, 416/244 B, 170 R

(56) References Cited

U.S. PATENT DOCUMENTS

| | | | | | |
|---|---|---|---|---|---|
| 3,444,932 | A | * | 5/1969 | Wilezen | 416/109 |
| 3,748,061 | A | | 7/1973 | Henrich | 416/93 |
| 4,566,855 | A | | 1/1986 | Costabile et al. | 416/134 |
| 4,575,310 | A | * | 3/1986 | Otani | 416/133 |
| 4,626,112 | A | * | 12/1986 | Kramer | 384/296 |
| 4,642,057 | A | | 2/1987 | Frazzell et al. | 440/52 |
| 4,701,151 | A | | 10/1987 | Uehara | 464/89 |
| 4,842,483 | A | * | 6/1989 | Geary | 416/2 |
| 5,201,679 | A | | 4/1993 | Velte et al. | 440/49 |
| 5,244,348 | A | | 9/1993 | Karls et al. | 416/204 |
| 5,252,028 | A | * | 10/1993 | LoBosco et al. | 416/134 R |
| 5,322,416 | A | | 6/1994 | Karls et al. | 416/204 |
| 5,908,284 | A | * | 6/1999 | Lin | 416/134 R |
| 6,383,042 | B1 | * | 5/2002 | Neisen | 416/134 R |

* cited by examiner

*Primary Examiner*—Edward K. Look
*Assistant Examiner*—Igor Kershteyn
(74) *Attorney, Agent, or Firm*—William D. Lanyi

(57) ABSTRACT

A torque transmitting device for use in conjunction with a marine propulsion system provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propulsor hub which can be a marine propeller or an impeller. A third insert portion is connected between the first and second insert portions and is resilient in order to allow the first and second insert portions to rotate relative to each other about the central axis of rotation. The adapter is shaped to prevent compression of the first, second, and third insert portions in a direction parallel to the central axis of rotation. The relative shapes of the various components and the resilience of the third insert portion, which can be a plurality of titanium rods, provides significant compliance of the device under low torque magnitudes, but at higher torque magnitudes it provides a significantly decreased compliance to facilitate torque transfer between a propulsor shaft and the propulsor hub.

35 Claims, 11 Drawing Sheets

TORQUE TRANSMITTING DEVICE FOR MOUNTING A PROPELLER TO A PROPELLER SHAFT OF A MARINE PROPULSION SYSTEM

BACKGROUND OF THE INVENTION

1. Field of the Invention

The present invention is generally related to a torque transmitting device for a marine propulsion system and, more particularly, to a device for allowing relatively significant twist to occur between the propeller shaft and the propeller hub at relatively low torque transfer magnitudes up to a preselected magnitude of twist, after which the torque transmitted as a function of relative twist (i.e. inch-pound per degree) increases significantly.

2. Description of the Prior Art

Many different types of mechanisms are known to those skilled in the art for the purpose of attaching a propeller to a propeller shaft.

U.S. Pat. No. 5,201,679 which issued to Velte et al on Apr. 13, 1993, describes a marine propeller with a breakaway hub. The marine propeller has an insert cavity with pentagonal cross section extending coaxially with the axis of rotation of the propeller, along with at least a portion of the length of the propeller. A resilient insert corresponding to the insert cavity is positioned in the insert cavity. The insert is sized for slip fit with the cavity and is adapted for connection with a propeller driveshaft. Preferably, the insert has a cylindrical aperture with a series of grooves disposed circumferentially thereabout extending coaxially through the inset and the insert is connected with the propeller shaft through a shaft sleeve. The shaft sleeve corresponds to the aperture in the insert, has a cylindrical outer surface with a series of teeth disposed circumferentially thereabout, and has a mounting aperture extending coaxially through the shaft sleeve. The shaft is sized for hand force slip fit engagement with the insert. The mounting aperture is adapted for mounting the marine propeller on the propeller shaft.

U.S. Pat. No. 3,748,061, which issued to Henrich on Jul. 24, 1973, describes a propeller construction in which a propeller includes a bushing part adapted to be mounted on a propeller shaft for common rotary movement of the bushing part with the propeller shaft. A resilient member is bonded to the outer periphery of the bushing and has an outer non-circular configuration including a series of alternate areas of greater and lesser radial distance form the axis of said bushing and a propeller blade part has a hub including a bore with an inner configuration including a series of alternate areas of greater and lesser radial distance from the axis of the propeller and detachably receiving the resilient member.

U.S. Pat. No. 5,244,348, which issued to Karls et al on Sep. 14, 1993, discloses a propeller drive sleeve. A shock absorbing drive sleeve is provided by a molded plastic member directly mounting the propeller hub to the propeller shaft. The sleeve has a rearward inner diameter portion engaging the propeller shaft in splined relation, and a forward inner diameter portion spaced radially outwardly of and disengaged from the propeller shaft. The drive sleeve has a rearward outer diameter portion, and a forward outer diameter portion engaging the propeller hub. The drive sleeve and the propeller hub are tapered relative to each other such that a forward outer diameter portion of the drive sleeve snugly engages the propeller hub, and a rearward outer diameter portion is spaced slightly radially inwardly of the hub by a small gap and may partially rotate relative to the propeller hub in response to rotation of the propeller shaft drivingly engaging the rearward inner diameter portion. When the propeller strikes an object, the shock is absorbed by torsional twisting of the drive sleeve wherein the rearward inner diameter portion and the rearward outer diameter portion continue to rotate to a further rotated position than the forward outer diameter portion, whereafter the splined teeth of the rearward inner diameter portion shear.

U.S. Pat. No. 4,701,151, which issued to Uehara on Oct. 20, 1987, describes a propeller damping arrangement for a marine propulsion device. A number of embodiments of coupling arrangements for coupling a propeller to a driving shaft that permit a higher degree of resilience in a circumferential direction than in an axial direction are disclosed. As a result, the coupling may be designed so as to offer high degree of vibration damping while affording good resistance to axial driving thrust. In addition, each embodiment is designed so as to provide more resilience in the reverse drive condition than in the forward drive condition.

U.S. Pat. No. 4,642,057, which issued to Frazzell et al on Feb. 10, 1987, discloses a shock absorbing propeller. A marine propeller mounting arrangement includes a sleeve member for mounting on a propeller shaft, a propeller having an inner hub which fits over the sleeve member and a cushion member fitting between the sleeve member and the propeller inner hub. The sleeve member includes radially extending projections registering the channels in the hub to positively drive the propeller, even in the event of failure of the cushion member. The propeller has an outer hub surrounding the inner hub to define an exhaust gas passageway through the propeller.

U.S. Pat. No. 4,566,855, which issued to Costabile et al on Jan. 28, 1986, describes a shock absorbing clutch assembly for a marine propeller. The propeller hub as an axial hole therein having a wavy, non-cylindrical surface consisting of a plurality of alternating peaks and valleys. A closely fitting resilient insert slips into the axial hub hole of the propeller hub and has an outer surface with peaks that extend into the respective valleys of the axial hub hole. The resilient insert has a cylindrical axial hole therein with a plurality of longitudinal keyways disposed in the surface of that hole. The keyways receive respective keys rigidly attached to the outer spline of a spline driver adapter sleeve, the inner surface of which has keyways that receive the splines of a driveshaft of a marine motor. The resilient insert transfers torque from the driving shaft to the hub without slippage of the torque is less than a predetermined amount, and absorbs shock if the propeller strikes a rock or the like by allowing the peaks of the hub hole to compress the peaks of the resilient insert. The resilient insert allows slipping of the hub relative to the driving shaft if the torque on the driveshaft exceeds a predetermined amount of torque.

U.S. Pat. No. 5,322,416, which issued to Karls et al on Jun. 21, 1994, discloses a torsionally twisting propeller drive sleeve. In a marine drive, a drive sleeve between the propeller shaft and the propeller hub absorbs shock after the propeller strikes an object by torsionally twisting between a forward end keyed to the propeller hub and a rearward end keyed to the propeller shaft. The drive sleeve is composed of a plastic material providing torsional twisting angular rotation at a first spring rate less than 100 lb. ft. per degree from 0° to 5° rotation, a second higher spring rate beyond 5° rotation, and supporting over 1,000 lb. ft. torque before failure.

The patents described above are hereby expressly incorporated by reference in the description of the preferred embodiment.

As can be seen in the descriptions of the prior art, as shown above, many different types of resilient inserts have been developed to connect a propeller hub to a propeller shaft and to achieve various desired advantages. One problem that is common in many different types of marine propulsion systems is the noise generally referred to as "prop rattle". This rattle actually occurs in the drive train and can be caused by the provision of a varying magnitude of torque at the propeller shaft. Since the propeller shaft and driveshaft of a marine propulsion device typically receive torque from an internal combustion engine, the sequential firing (i.e. igniting of the fuel/air mixture) within the combustion chambers of the engine creates individual pulses of downward force on the associated pistons. These individual downward forces transmit torque to the crankshaft of the engine as distinct pulses. These distinct pulses of torque are transmitted through the interconnection of the crankshaft to the driveshaft and, in turn, to the propeller shaft. Therefore, the torque provided at the propeller shaft is not constant over time but, instead, comprises a plurality of distinctive peaks of torque that are generally coincident with the downward movement of the various pistons of the internal combustion engine.

Since the rotating propeller hub and blades attached to the propeller shaft have a certain degree of inertia, the intermittent torque peaks described above create a situation in which the propeller shaft and the propeller hub oscillate angularly relative to each other. In other words, when the propeller shaft experiences a torque peak as a piston transmits torque to the crankshaft, the propeller shaft rotates relative to the propeller hub in a first direction. Then, as the propeller hub reacts to this torque peak at a slightly later time, the propeller hub rotates at a higher angular velocity than the propeller shaft and the relative angular positions of the propeller shaft and the propeller hub move to an opposite direction. As a result, under certain circumstances, the propeller hub and the propeller shaft continually oscillate relative to each other about their common central axis. This oscillation can result in relative angular reversals of various components in the power transmission system which includes the propeller shaft, the clutch, the bevel gear, the driveshaft, and the crankshaft of the engine. This relative oscillation between components create the audible "prop rattle" that can diminish the enjoyment of operating a marine vessel.

In view of the above discussion, it can be seen that it would be significantly beneficial if a torque transmitting component could be provided that allows significant relative rotation between the propeller hub and the propeller shaft at relatively low magnitudes of torque transfer between those components up to a significant angular displacement between the propeller shaft and propeller hub. Correspondingly, it would also be significantly beneficial if this type of torque transmitting component could also transmit significant magnitudes of torque when the relative rotation between the propeller hub and propeller shaft increase beyond a relatively high magnitude of twist. As a result, "prop rattle" would be significantly reduced or eliminating when the engine is operating at idle speed with small amounts of torque being transmitted between the propeller shaft and propeller hub, but with the provision that at higher relative twists between the propeller shaft and propeller hub large magnitudes of torque can be provided when the associated marine vessel is operated at higher speeds.

SUMMARY OF THE INVENTION

A torque transmitting device for a marine propulsion system made in accordance with the present invention comprises an adapter that is shaped to be attached in torque transmitting relation with a propulsor shaft of the marine propulsion system. The propulsor shaft is rotatable about a central axis of rotation. The propulsor shaft can be either a propeller shaft or a shaft for an impeller. A first insert portion is shaped to be attached in torque transmitting relation with the adapter and a second insert portion is shaped to be attached in torque transmitting relation with a propulsor hub. The propulsor hub can be the hub of either a propeller or impeller. A third insert portion is connected between the first and second insert portions and is resilient in order to allow the first and second insert portions to rotate relative to each other about the central axis of rotation of the propulsor shaft. The adapter is shaped and proportioned relative to the other components of the present invention to prevent the first, second, and third insert portions from being compressed in a direction parallel to the central axis of rotation when the adapter is attached to the propulsor shaft.

In a particularly preferred embodiment of the present invention, the adapter comprises an inner opening which has a first plurality of axially extending ridges shaped to mesh with a second plurality of axially extending ridges formed on an outer surface of the propulsor shaft. In other words, the adapter has an inner opening that has spline teeth that can mate in meshing relation with spline teeth on the propulsor shaft. The adapter is disposable in coaxial relation with the propulsor shaft about the central axis of rotation, whereby rotation of the propulsor shaft causes synchronous rotation of the adapter. In certain embodiments of the present invention, the adapter comprises an outer surface having a first discontinuity formed therein by ridges, said first insert portion comprising an inner surface having a second discontinuity formed therein by grooves, with the first and second discontinuities. being shaped to attach the first insert portion to the adapter for rotation in synchrony with the adapter. In a preferred embodiment of the present invention, a second insert portion comprises an inner surface having a third discontinuity formed therein by grooves, with the first and third discontinuities being shaped to attach the second insert portion to the adapter in a manner which permits a first predetermined magnitude of relative rotation between the adapter and the second insert portion. The first predetermined magnitude of relative rotation is provided by a first space between the first and second discontinuities which allows lost motion to occur between the second insert portion and the adapter.

In a preferred embodiment of the present invention, the second insert portion comprises an outer surface that is shaped to be received by the propulsor hub and attach the second insert portion to the propulsor hub for rotation in synchrony with the hub. The first insert portion comprises an outer surface that is shaped to be received within the second propulsor hub in order to attach the first insert portion to the propulsor hub for rotation in a manner which permits a second predetermined magnitude of relative rotation between the first insert portion and the propulsor hub. The second predetermined magnitude of relative rotation is provided by a second space between the outer surface of the first insert portion and an inner surface of the propulsor hub which allows lost motion to occur between the first insert portion and the propulsor hub.

The third insert portion, in a preferred embodiment of the present invention, is sufficiently resilient to allow a third predetermined magnitude of relative rotation to occur between the first and second insert portions. The third insert portion can comprise a plurality of metal rods that are attached between the first and second insert portions. The metal rods can be titanium. It should be understood that nonmetallic rods can also be used. In a preferred embodiment of the present invention, the first, second, and third insert portions are separable components, wherein the first and second insert portions are each removably attached to the third insert portion.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
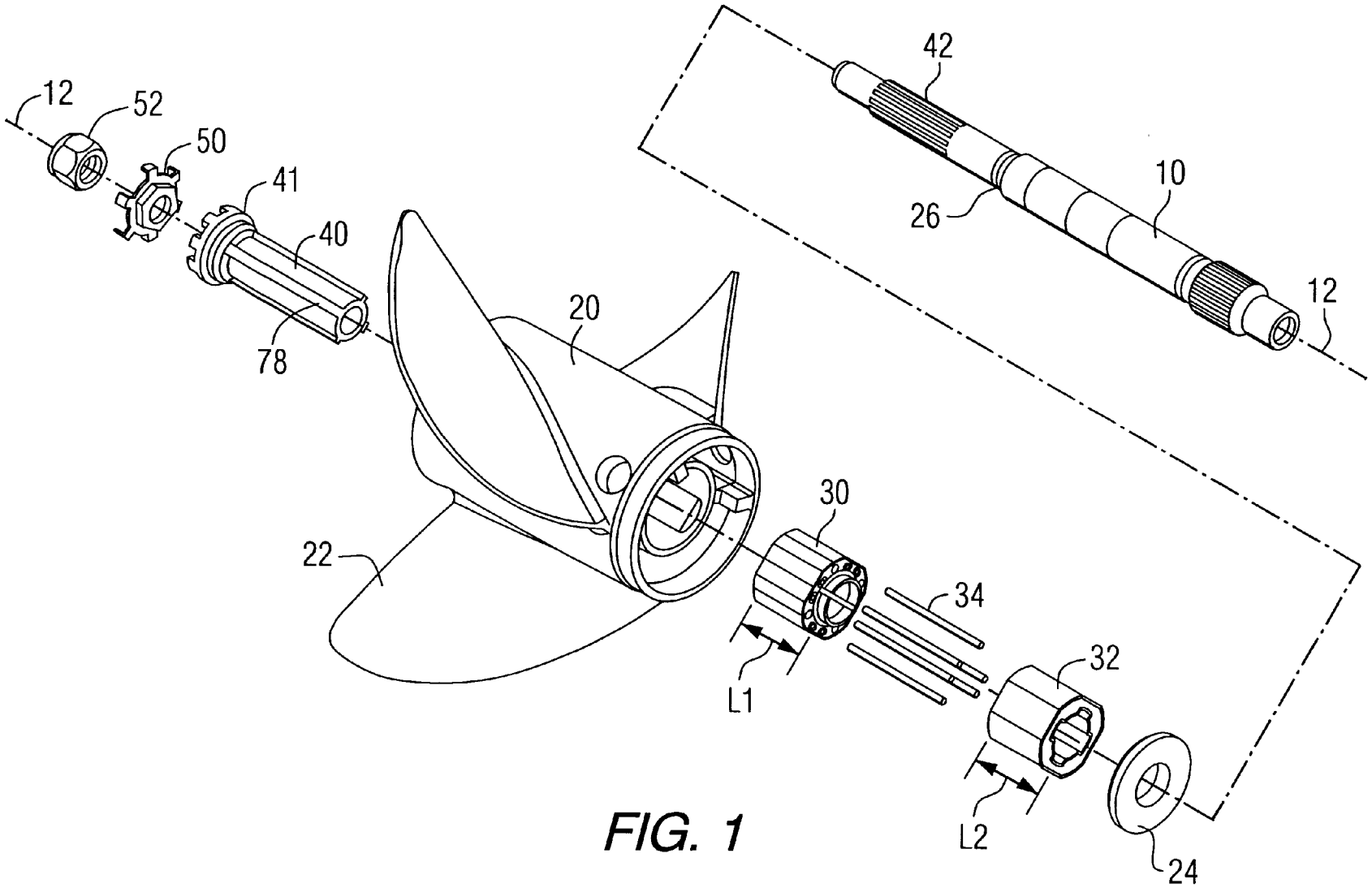
FIG. 1 is an exploded isometric view of the present invention associated with a propulsor hub and a propulsor shaft.

Throughout the description of the preferred embodiment of the present invention, like components will be identified by like reference numerals.

FIG. 1 shows a propulsor shaft 10 which is rotatable about a central axis of rotation 12. It should be understood that, although not illustrated in FIG. 1, the propulsor shaft is typically disposed in a gear housing of a marine propulsion system, such as an outboard motor or a stern drive unit. In addition, the propulsor shaft 10 is typically connected in torque transmitting relation with the driveshaft of a marine propulsion system which, in turn, is connected in torque transmitting relation with a crankshaft of an internal combustion engine. FIG. 1 also shows a propulsor hub 20 having a plurality of blades 22 attached to the propulsor hub 20. In FIG. 1, the propulsor is a propeller, but it should be understood that the propulsor could also be an impeller in alternative embodiments of the present invention.

With continued reference to FIG. 1, the propulsor hub 20 is mounted on the propulsor shaft 10 by first moving the washer 24 to a position on the propulsor shaft 10 against ridge 26 to prevent further movement of the washer 24 axially with respect to the propulsor shaft 10. A first insert portion 30 and a second insert portion 32 are attached together by a third insert portion 34 which comprises a plurality of metal rods that are attached to both the first and second inserts portions as will be described in greater detail below. When assembled together, the first 30, second 32, and third 34 insert portions are movable into the inner portion of the propulsor hub 20. This assembly will be described in greater detail below.

An adapter 40 is shaped to be attached in torque transmitting relation with the propulsor shaft 10. This is accomplished by providing splined grooves on an inner surface of the adapter 40 that mate with the splines 42 on the propulsor shaft 10. A locking device 50 and a nut 52 are used to rigidly attach the adapter 40 to the propulsor shaft 10 and prevent relative axial motion of the propulsor shaft 10 and adapter 40 along the axis 12. When the components shown in FIG. 1 are assembled together, and the nut 52 is tightened to rigidly attach the adapter 40 to the propulsor shaft 10, all of the components are disposed in coaxial relation with the central axis 12.

With continued reference to FIG. 1, it should be noted that the effective axial length of the adapter 40 is greater than the combined lengths of the first insert portion 30 and second insert portion 32, represented as L1 and L2 in FIG. 1. As will be described below, the assembled length of the first and second insert portions, 30 and 32, can actually be greater than the sum of their individual lengths, L1 and L2, and the effective length of the adapter 40 is greater than the assembled length of the first and second insert portions, 30 and 32, combined with a portion of the hub 20. This will be described in greater detail below.

Figure 2:
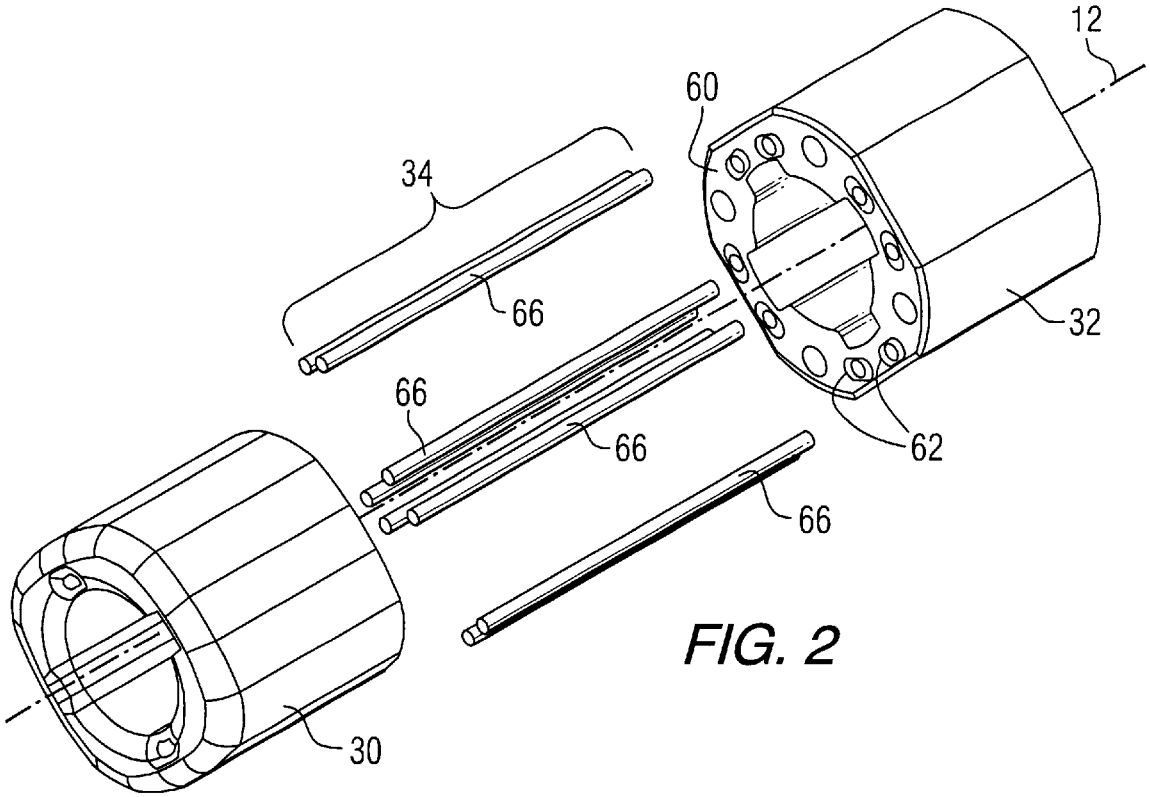
FIG. 2 is an exploded isometric view of the first, second, and third insert portions of the present invention.

FIG. 2 is an exploded isometric view of the first insert portion 30 and second insert portion 32. As can be seen on the inner axial face 60 of the second insert portion 32, a plurality of openings 62 are formed as cavities that extend axially into the body of the second insert portion 32. The first insert portion 30 also has matching openings 62 formed in its body, but these are not visible in the isometric view in FIG. 2. All of the openings formed in the axial faces 60 of the first and second inserts portions, 30 and 32, are shaped to receive the rods 66. In the embodiment shown in FIG. 2, the third insert portion 34 comprises 8 metal rods 66 which are made of titanium in order to more robustly resist corrosion when the system is used in a salt water environment. As will be described in greater detail below, the openings 62 narrow to an interference portion 64 (not shown in FIG. 2) which grip the associated ends of the rods 66.

Figure 3:
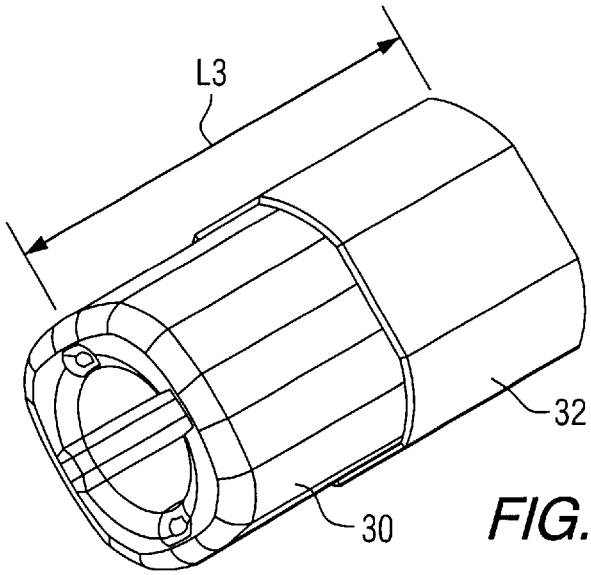
FIG. 3 is an assembled view of the components shown in FIG. 2.

FIG. 3 is an isometric view of the assembled component that comprises the first insert portion 30, the second insert portion 32, and the third insert portion 34 which, in turn, comprises the eight titanium rods 66. When the first and second insert portions, 30 and 32, are assembled together, the sum of the combined or assembled length L3, plus a portion of the hub 20, is less than the effective length of the adapter 40 as described above in conjunction with FIG. 1. This is an important characteristic of the present invention because it prevents the axial compression of the assembled insert component shown in FIG. 3 when the nut 52 is tightened on the propulsor shaft 10 as described above in conjunction with FIG. 1. As a result, the assembled insert portions are protected between the washer 24 and the aft end 41 of the adapter 40. No matter how tightly the nut 52 is tightened onto the propulsor shaft 10, the assembly can not compress the first and second insert portion, 30 and 32. This feature will be described in greater detail below in conjunction with FIG. 11.

Figure 4B:
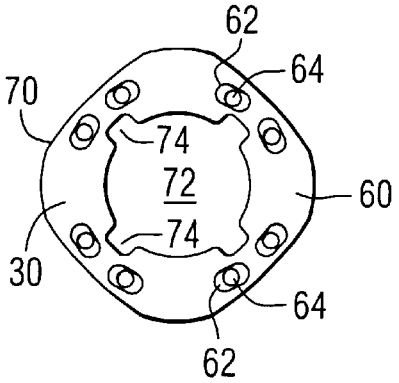
FIGS. 4A–4D show various views of the first insert portion of the present invention.
Figure 4A:
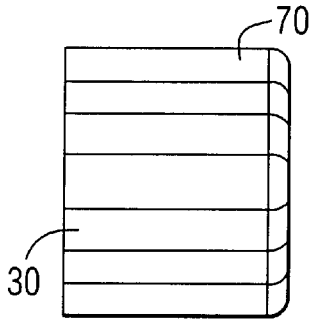

FIGS. 4A–4D show various views of the first insert portion 30. The first insert portion 30 comprises an outer surface 70 that is shaped to be received by the propulsor hub 20 in order to attach the first insert portion 30 to the propulsor hub for rotation in a manner that permits a predetermined magnitude of relative angular motion between the first insert portion 30 and the propulsor hub 20 shown in FIG. 1. In FIG. 4A, the outer surface 70 of the first insert portion 30 comprises a plurality of flat segments that define the size of the outer surface 70. As will be described in greater detail below, the outer surface size of the first insert portion 30 is smaller than its associated inner surface of the hub 20. This differential in size allows relative rotation to occur between the first insert surface 30 and the hub 20. This will be described in greater detail below in conjunction with FIGS. 8A and 8B.

In FIG. 4B, it can be seen that the inner opening 72 of the first insert portion 30 comprises a plurality of grooves 74. These grooves 74 are shaped to receive the axially extending ridges 78 of the adapter 40. In other words, the adapter 40 comprises an outer surface having a plurality of ridges 78 that define a first discontinuity and the first insert portion 30 has an inner surface with a plurality of grooves 74 which define a second discontinuity. The first and second discontinuities are shaped to attach the first insert portion 30 to the adapter 40 for rotation in synchrony with the adapter 40. In other words, as the propulsor shaft 10 causes the adapter 40 to rotate in synchrony with it, because of the meshing of the splines 42, the adapter 40 causes the first insert portion 30 to rotate in synchrony with the adapter 40, with virtually no relative angular motion between the adapter 40 and the first insert portion 30. In this description, this type of rotation without relative angular movement between components is described to as rotation in synchrony. The grooves 74 are shaped to receive the ridges 78 with very little or no gap therebetween.

Figure 4C:
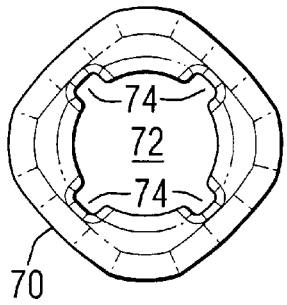

FIG. 4C shows the opposite end of the illustration in FIG. 4A than FIG. 4B. In FIG. 4C, the grooves 74 can also be seen defining the second discontinuity which mates with the ridges 78 of the adapter 40 shown in FIG. 1.

Figure 4D:
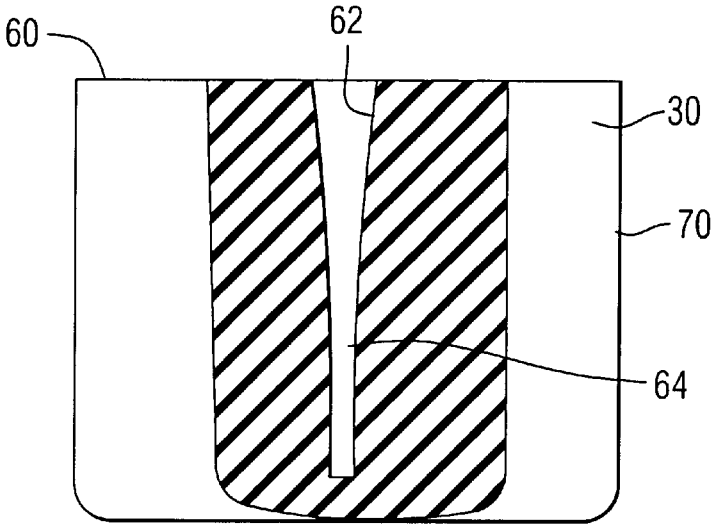

FIG. 4D is a partially sectioned view of a first insert portion 30 showing the opening 62 which extends axially into the first insert portion 30 from the face 60. As can be seen, the opening 62 is widest at its intersection with the face 60, but it narrows to the interference portion 64 that is shaped to grip an end of one of the rods 66 and hold the rod in place. As a result, the rods 66 are firmly held in place in the plurality of interference portions 64 of both the first and second insert portions, 30 and 32, and this provides a force which holds the first and second insert portions firmly together as an assembly.

Figure 5B:
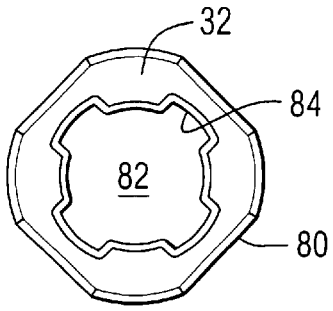
FIGS. 5A–5D show various views of the second insert portion of the present invention.
Figure 5A:
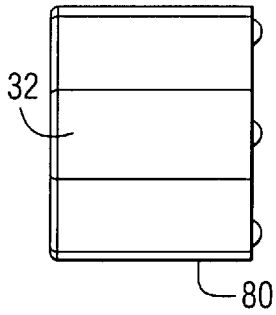
Figure 5C:
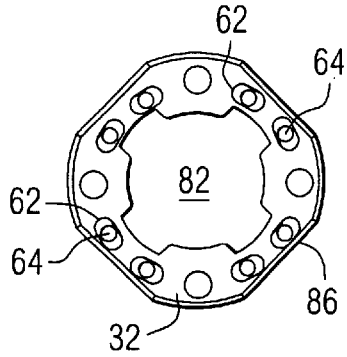

FIG. 5A shows a second insert portion 32 with an outer surface 80. The outer surface 80 of the second insert portion 32 is larger than the outer surface 70 of the first insert portion 30. Also, the outer surface 80 is shaped to be received, with a press fit relationship, in an inner opening of the propulsor hub 20 in such a way that little or no relative rotation is permitted between the second insert portion 32 and the hub 20.

In FIG. 5B, which is an end view of FIG. 5A, a plurality of grooves 84 define a third discontinuity on the surface of the opening 82. The third discontinuity is shaped to receive the ridges 78 of the adapter 40 within the grooves, but with clearance. As a result, the first discontinuity defined by the ridges 78 of the adapter 40 and the third discontinuity defined by grooves 84 of the second insert portion 82 are shaped to attach the second insert portion 32 to the adapter 40 in a manner which permits a first predetermined magnitude of relative rotation between the adapter 40 and the second insert portion 32. Unlike the smaller grooves 74 described above in conjunction with FIG. 4B, which hold the first insert portion 30 tightly to the ridges 78 of the adapter 40, the larger grooves 84 of the second insert portion 32 allow relative movement between the second insert portion 32 and the adapter 40.

Figure 5D:
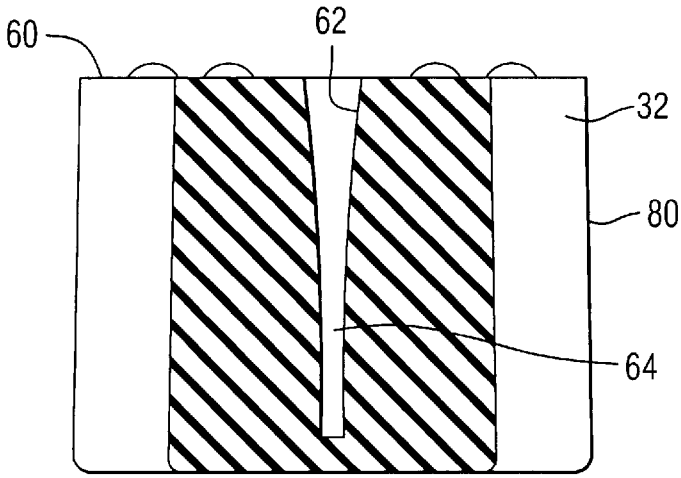

FIG. 5D is a partially sectioned view of a second insert portion 32, showing the opening 62 which is largest at its point of intersection with face 60, but narrows to its interference portion 64 that is shaped to grip an end of one of the rods 66 of the third insert portion 34.

Figure 6B:
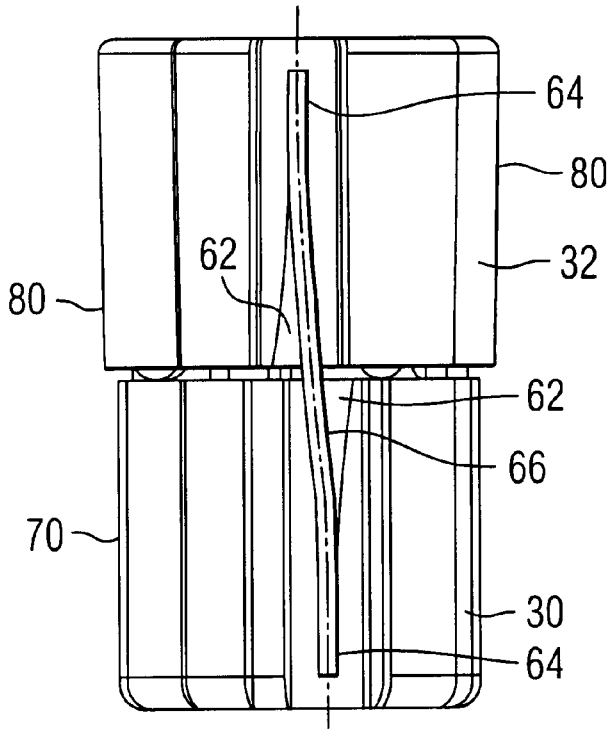
FIGS. 6A and 6B are partially sectioned views of the first, second, and third insert portions of the present invention in both an untwisted and twisted configuration.
Figure 6A:
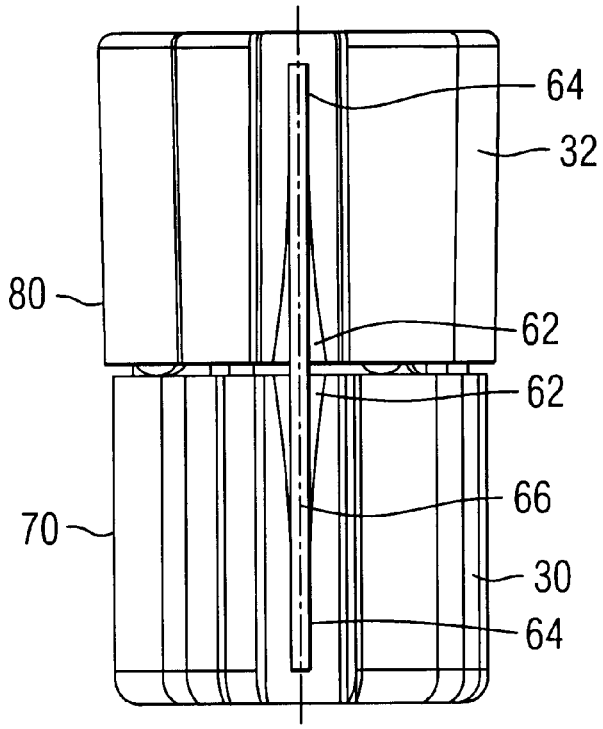

FIGS. 6A and 6B show partially sectioned views of the first and second insert portions, 30 and 32, with the rod 66 of the third insert portion connected to both the first and second insert portions. In FIG. 6A, the rod 66 is unstressed because no relative rotation has occurred between the first and second insert portions, 30 and 32. It can be seen that the ends of the rod 66 are inserted into the interference portion 64 of the openings 62 of both insert portions. This assists in holding the two insert portions firmly together as an assembled unit.

FIG. 6B is similar to FIG. 6A, but with relative rotation between the first and second insert portions, 30 and 32. As a result, the ends of rod 66 have moved with their respective insert portions as those two components rotate relative to each other. The rod 66 of the third insert portion bends to conform to this relative rotation between the first and second insert portions. In operation, the first insert portion 30 moves in synchrony with the adapter 40, but the second insert portion 32 is free to rotate relative to the adapter 40 because of the larger grooves 84 formed in its interior opening. Therefore, the initial relative rotation between the first and second insert portions results in the bending of rod 66 and the transfer of torque between the first and second insert portions by way of the rods 66. Torque is transferred from the first insert portion 30 to the second insert portion 32 and subsequently to the propulsor hub because of the relatively close fit between the outer surface 80 of the second insert portion 32 and the inner surface of the propulsor hub 20.

With reference to FIGS. 6A and 6B, it can be seen that the flexing of the resilient rod 66 can absorb the pulses of torque transmitted through the propulsor shaft 10 as the pistons of the internal combustion engine fire in sequenced pulses. This will be described in greater detail below in conjunction with FIG. 13. As a result, the reciprocating oscillations of the propulsor shaft 10 are not immediately transferred to the propulsor hub 20. The operation of the rods 66, as shown in FIGS. 6A and 6B, significantly decrease the "prop rattle" that is normally caused by noise emanating from the various connections between shafts, clutch, and gears in the drive system of the marine propulsion system.

Figure 6C:
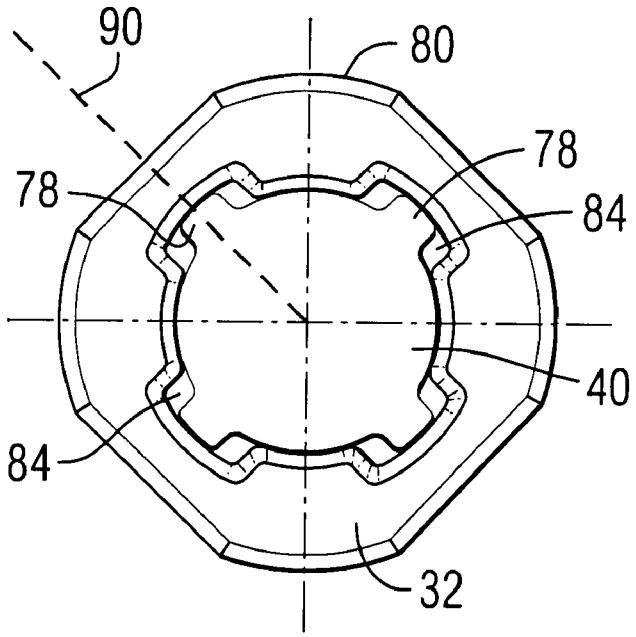
FIG. 6C is an end view of the second insert portion of the present invention and the adapter.
Figure 6D:
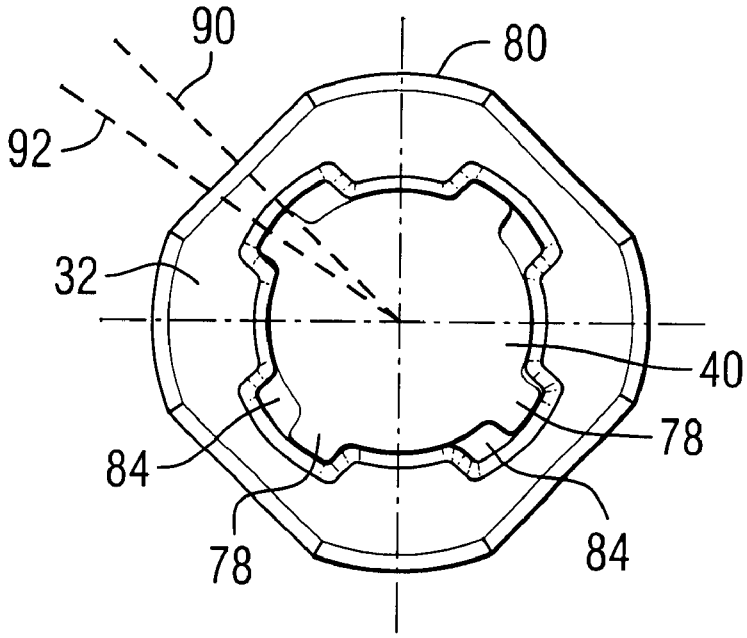

FIGS. 6C and 6D illustrate how the second insert portion 32 is able to move relative to the adapter 40. In FIG. 6C, dashed line 90 shows the ridges 78 generally centered within their respective grooves 84. When located in the positions illustrated in. FIG. 6C, the adapter 40 and the second insert portion 32 are able to rotate relative to each other without transmitting torque therebetween other than through the rods 66. FIG. 6D shows the relationship between the second insert portion 32 and the adapter 40 after relative rotation has occurred between these two components. Dashed line 92 represents a center of the ridges 78 while dashed line 90 represents the center of the grooves 84. As can be seen in FIG. 6D, the ridges 78 have moved against one wall of their respective grooves 84 and, as a result, the adapter 40 has moved into high torque transmitting relation with the second insert portion 32.

With continued reference to FIGS. 6A and 6B, it can be seen that the first insert portion 30 has a smaller outside dimension than the second insert portion 32. This differential in size serves a valuable function in torque transmitting devices made in accordance with the present invention. The difference in outer surface size between surfaces 70 and 80 allows relative rotation between the first insert portion 30 and the inner surface of the propulsor hub 20, but does not allow that same degree of relative rotation between the second insert portion 32 and the inner surface of the propulsor hub 20. This function can best be understood by viewing FIGS. 7, 8A, and 8B.

Figure 7:
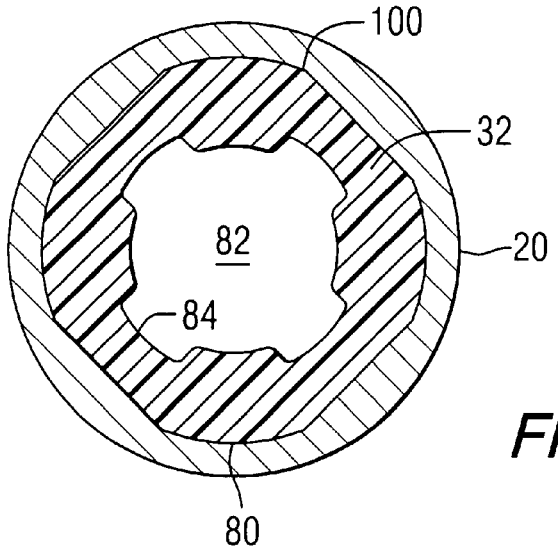
FIGS. 7A and 7B show two section views of the propulsor hub associated with the second insert portion.

FIG. 7 shows the second insert portion 32 disposed within the propulsor hub 20. The second insert portion 32 is disposed within the propulsor hub 20 in a press fit relationship. Therefore, no intentional gap exists at the interface 100 between the outer surface 80 of the second insert portion 32 and the inner surface of the propulsor hub 20. As a result, these two components rotate in synchrony with each other with no lost motion. However, as described in detail above, groove 84 is shaped to allow the associated ridges 78 of the adapter 40 to move within them. This allows relative rotation between the adapter 40 and the second insert portion 32.

Figure 8A:
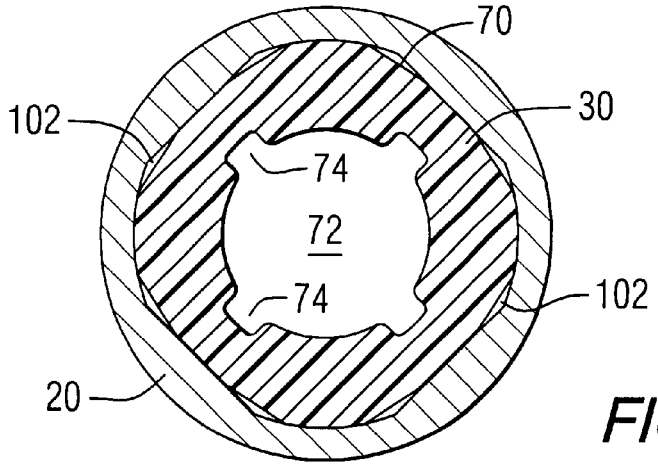
FIGS. 8A and 8B show two section views of the propulsor hub in relation to the first insert portion.
Figure 8B:
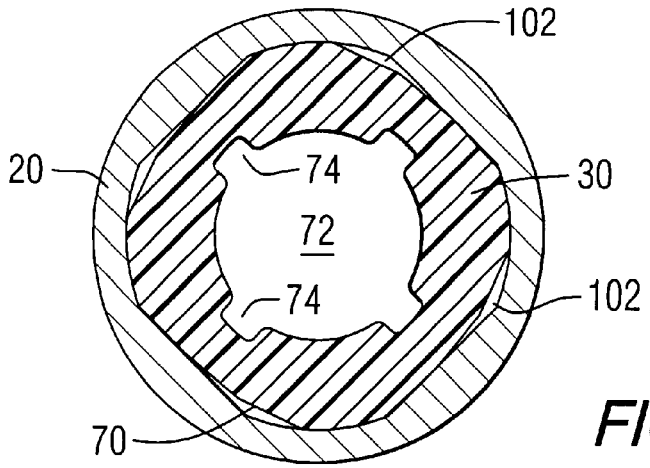

With reference to FIGS. 8A and 8B, it can be seen that the gap 102 between the outer surface 70 of the first insert portion 30 and the inner surface of the propulsor hub 20 is relatively larger than the gap 100 described above in conjunction with FIGS. 7A and 7B. This larger gap 102 is intentional and results from the smaller size of surface 70, compared to the larger size of surface 80. As a result, rotation of the first insert portion 30 does not immediately transfer torque to the propulsor hub 20. As shown in FIG. 8B, a relatively significant magnitude of relative rotation between the first insert portion 30 and the propulsor hub 20 is necessary before the outer surface 70 contacts the inner surface of the propulsor hub 20 to move these two components in torque transmitting relation. However, it should be understood that, as described above, the grooves 74 in the first insert portion 30 are shaped to receive the ridges 78 of the adapter 40 in such a way that no intentional relative rotation can occur between the adapter 40 and the first insert portion 30.

With reference to FIGS. 7, 8A, and 8B, it should be understood that the relationship between the adapter 40 and the first and second insert portions, 30 and 32, causes torque to be immediately transmitted from the adapter 40 to the first insert portion 30 in response to any rotation of the adapter 40. This movement, in synchrony, between the adapter 40 and the first insert portion 30 causes relative rotation to occur between the first insert portion 30 and the propulsor hub 20 as shown in FIGS. 8A and 8B. Therefore, torque is not immediately transmitted between the first insert portion 30 and the propulsor hub 20, as illustrated in FIGS. 8A and 8B. Instead, torque is transmitted between the first insert portion 30 and the second insert portion 32 through the third insert portion 34, which comprises the resilient titanium rods 66. This then transmits torque to the second insert portion 32, causing rotation of the second insert portion. As described above in conjunction with FIG. 7, this rotation of the second insert portion 32 immediately begins to transmit torque to the propulsor hub 20 because of the press fit relationship between these two components. Therefore, at relatively low magnitudes of torque and at relatively low relative rotations between the propulsor shaft 10 and the propulsor hub 20, torque is transmitted only through the rods 66. At higher torques, which are sufficient to cause the adapter ridges 78 to move within grooves 84 of the second insert portion 32 and transmit torque therebetween as described above in conjunction with FIG. 6D, additional stress on the resilient rods 66 is inhibited and torque is provided directly from the adapter 40 to the first and second insert portions, 30 and 32, and, in turn, to the propulsor hub 20.

Figure 9:
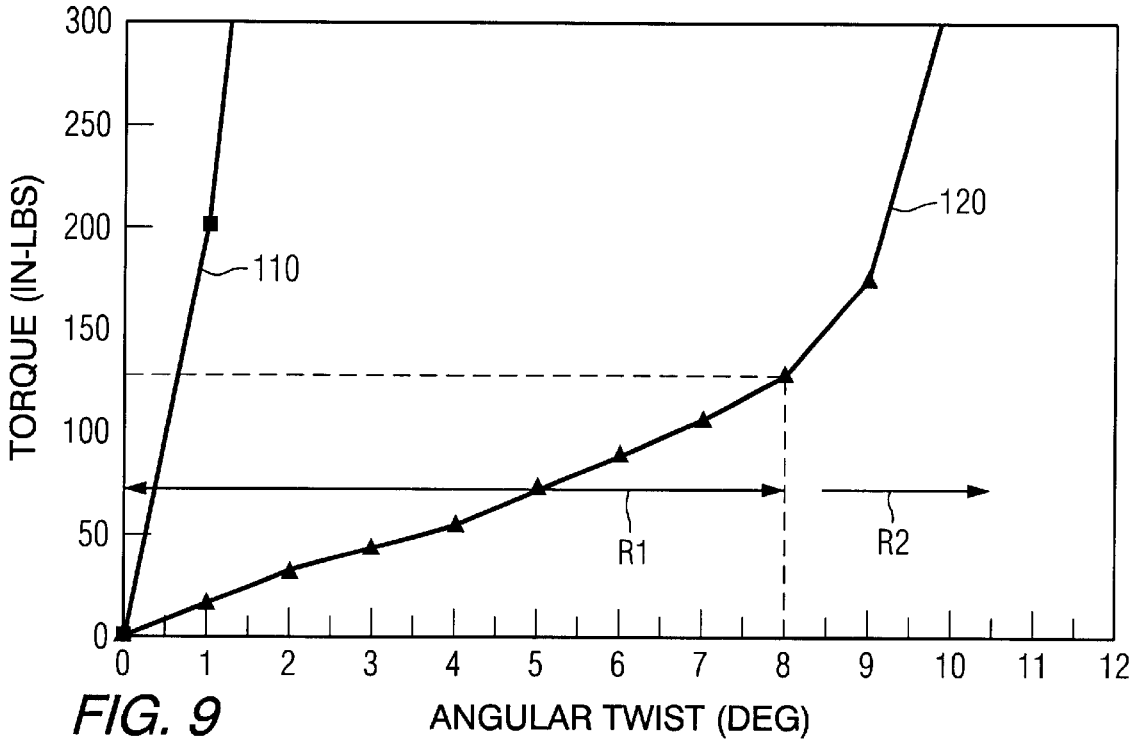
FIG. 9 is a graphical representation of the torque transfer rates of the present invention and a known prior art torque transmitting device.

FIG. 9 is a graphical representation which illustrates the relationship between hub torque transmitted from the propulsor shaft 10 to the propulsor hub 20 as a function of relative hub twist between the propulsor shaft 10 and the propulsor hub 20. Known systems, as represented by line 110, exhibit a relatively high transfer rate of torque per degree rotation even at relatively low magnitudes of twist. The torque transmission device that results in the relationship represented by line 110 is inadequate for the intended purpose of providing compliance at low torque magnitudes to reduce "prop rattle" while providing reduced compliance at is higher torque magnitudes when the marine vessel is operating at higher speeds and loads. Line 120 in FIG. 9 illustrates the relationship provided by the present invention. As can be seen, the compliance of the torque transmitting device of the present invention at low torque magnitudes is much higher than the known device represented by line 110. This compliance, which results in relative hub twists of up to 8° or more at relatively low torque magnitudes of 125 inch-pounds or greater. At higher torque magnitudes, the present invention provides a similar slope of curve to the prior art device. In other words, the slope of the rightmost segment of both curves, 110 and 120, are generally similar to each other. However, the slope of the two curves at low torque magnitudes are significantly different, with the present invention providing a much more compliant relationship than the prior art devices up to about 8° of twist. The present invention, in effect, provides a dual rate of compliance with the dual rates being significantly different from each other as represented by line 120 in FIG. 9.

It has been determined that undesirable audible noise originates from the repeated separating and reuniting of metallic components associated with the torque transmission system in marine vessels. In other words, clutch dogs and bevel gears are repeatedly forced into separation and subsequent contact because of the interrelationship of the torque pulses resulting from the firing of pistons of an internal combustion engine and the resisting inertia torque of the propulsor hub 20. The present invention provides a solution for this problem, referred to herein as "prop rattle". At low speeds and loads, the present invention provides a high degree of compliance between the propulsor shaft 10 and the propulsor hub 20. This high degree of compliance exists for the magnitudes of relative hub twist represented by range RI in FIG. 9. This first stage compliance effectively isolates the propulsor hub from the torque pulses experienced at the propulsor shaft 10, which are the result of the sequential firing of the pistons of the internal combustion engine. At torque levels above a predetermined magnitude, represented by range R2, the present invention provides a generally rigid connection between the propulsor shaft 10 and the propulsor hub 20. This second stage compliance allows for a high magnitude of torque transmission from the propulsor shaft 10 to the propulsor hub 20 and maintains the satisfactory conditions that eliminate the undesirable audible noises of known marine propulsion systems.

With continued reference to FIG. 9, it can be seen that the present invention provides a torque transfer of less than 125 inch-pounds when the adapter 40 and the propulsor hub 20 experience relative rotation which is less than 8°. However, this torque transfer clearly exceeds 125 inch-pounds when the adapter 40 and the propulsor hub 20 experience relative rotation greater than 9° to 10°.

Alternatively stated, the present invention provides a torque transfer rate of less than 50 inch-pounds per degree when the adapter 40 and the propulsor hub 20 experience relative rotation less than 8° (see FIG. 12), but exhibit a torque transfer rate greater than 100 inch-pounds per degree when the adapter 40 and the propulsor hub 20 experience relative rotation of greater than 9°.

Figure 10:
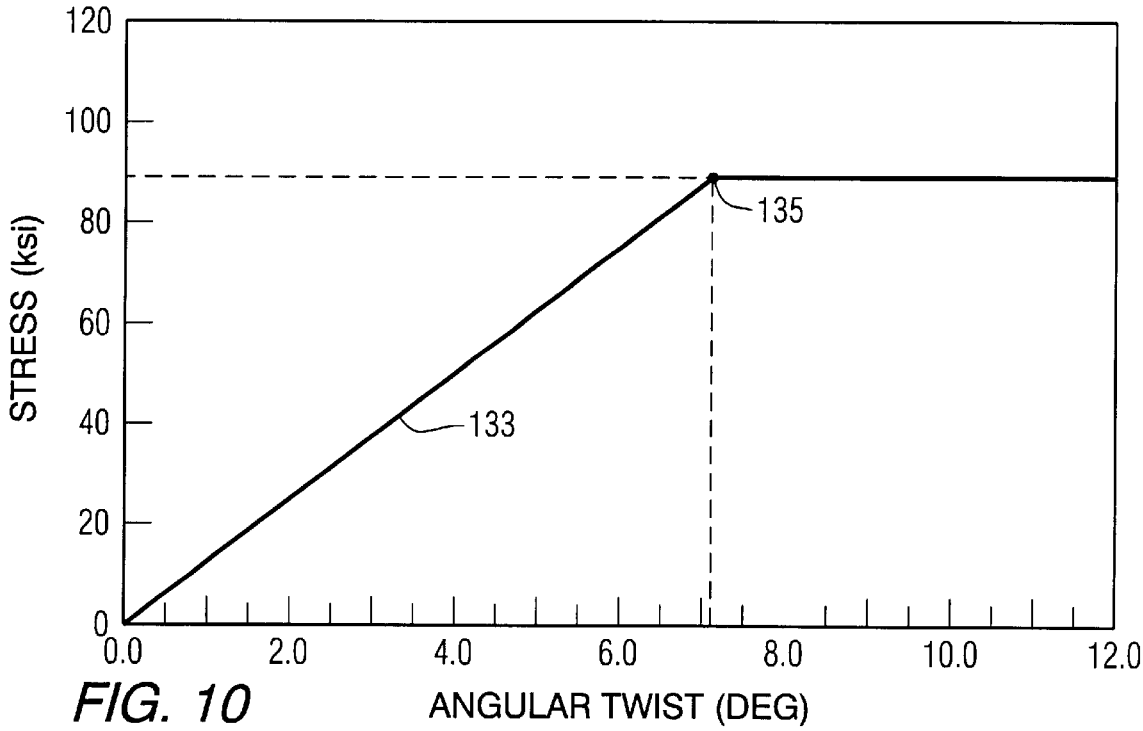
FIG. 10 is a graphical representation of the stress on the rods of the third insert portion as a function of angular twist.

FIG. 10 is a graphical representation which shows the stress on the titanium rods 66 as relative twist occurs between the first and second insert portions, 30 and 32. The bending of the rods 66, which are illustrated in FIGS. 6A and 6B create stress in the rods 66 as torque is transferred between the first and second insert portions. The stress, plotted on the vertical axis of FIG. 10, is shown as a function of the magnitude of angular twist, or relative rotation, between the first and second insert portions. As can be seen, the magnitude of stress represented by line 133 rises from zero to a maximum represented by 0.135. When the angular twist reaches a predetermined maximum, such as the 7° shown in FIG. 10, the outer surface of the first insert portion 30 contacts the inner surface of the propulsor hub 20, as represented in FIG. 8B and torque is transmitted directly between the first insert portion 30 and the propulsor hub 20. When the first insert portion 30 begins to share the load, the stress on the rods 66 no longer increases and, instead,. remains constant as represented by line 135 in FIG. 10 above the magnitude of 7° angular twist.

Figure 11:
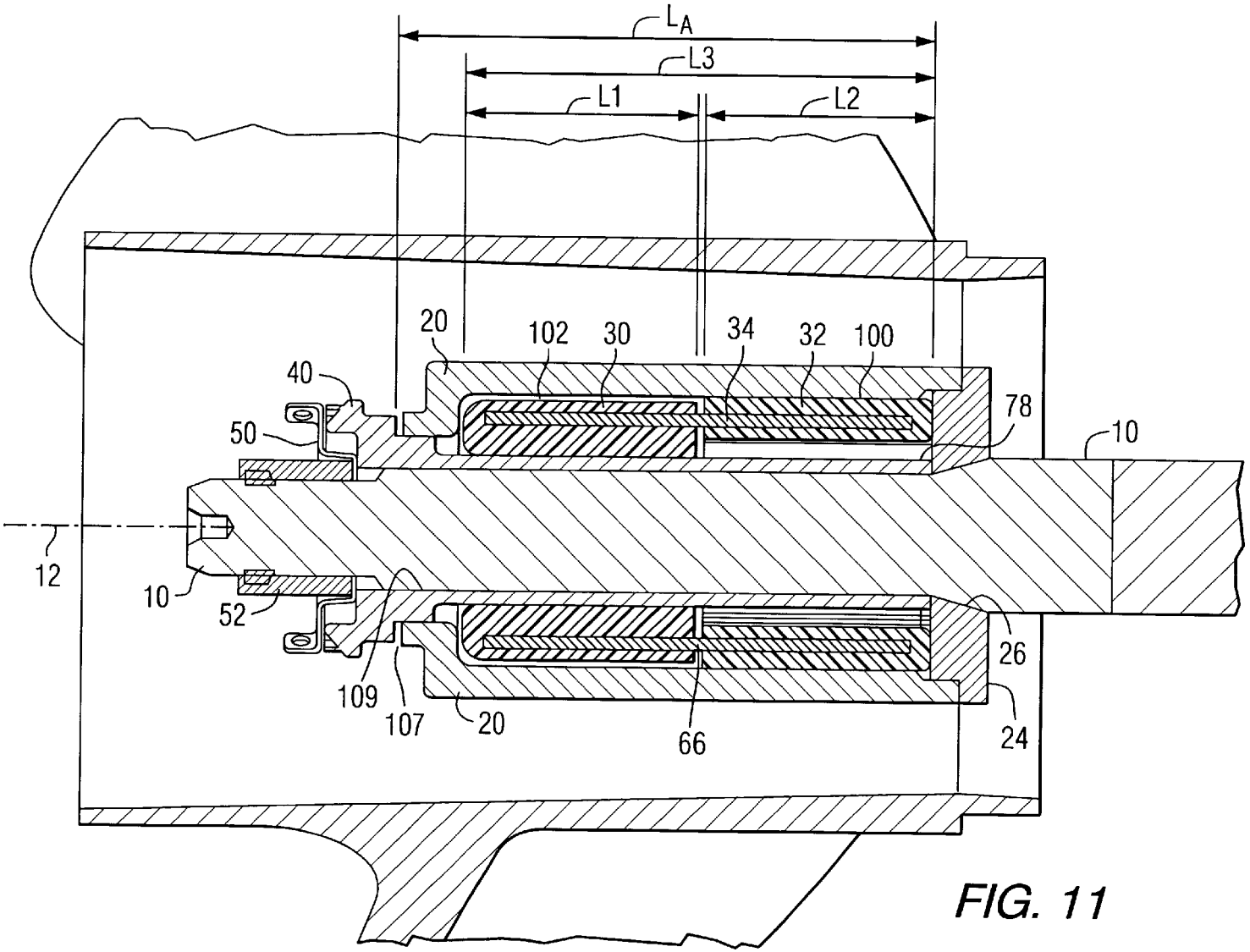
FIG. 11 is a side section view of the present invention associated with a propulsor hub.

FIG. 11 is a side section view of the present invention assembled within a propulsor hub 20. The adapter 40 of the present invention is shaped to be attached in torque transmitting relation with a propulsor shaft 10 of the marine propulsion system. The propulsor shaft 10 is rotatable about its central axis 12. A first insert portion 30 is shaped to be attached in torque transmitting relation with the adapter 40 and a second insert portion 32 is shaped to be attached in torque transmitting relation with the propulsor hub 20. A third insert portion 34, which comprises a plurality of titanium rods 66, is connected between the first insert portion 30 and the second insert portion 32. A third insert portion 34 is resilient and allows the first and second insert portions to rotate relative to each other about the central axis 12 as the titanium rods 66 bend to accommodate this relative rotation. The adapter 40 is shaped to prevent the first, second, and third insert portions from being compressed in a direction parallel to the central axis 12 when the adapter 40 is attached to the propulsor shaft 10 and clamped in the axial direction by a nut 52. This characteristic is important because prevention of axial compression of the first, second, and third insert portions allows them to work effectively and provide the dual rate of compliance described above. As shown in FIG. 11, the effective length $L_A$ of the adapter 40 is greater than the combined length L3 of the first and second insert portions, 30 and 32. The individual axial lengths of the first and second insert portions are identified as L1 and L2, but a slight axial gap exists between the first and second insert portions and, therefore, the combined length L3 is slightly greater than the sum of the two individual lengths, L1 and L2. In addition, it should be noted that a small gap 107 exists between an axial face of the adapter 40 and an opposing axial face of the propulsor hub 20. Because of the selected lengths of the adapter 40, the first insert portion 30, and the second insert portion 32 in relation to the related axial length of the propulsor hub 20, in conjunction with the washer 24, the first and second insert portions, 30 and 32, can not be crushed or compressed in an axial direction as a result of the nut 52 being tightened onto the propulsor shaft 10. This characteristic of the present invention is very important because it allows the first and second insert portion to effectively perform their intended function. If the first and second insert portions, 30 and 32, were axially compressed together, torque could be directly transferred from the propulsor shaft 10 to the propulsor hub 20 and the relative rotation provided by the present invention would be less effective.

The adapter 40 comprises an inner opening 109, in FIG. 11, having a first plurality of axially extending ridges which are shaped to mesh with a second plurality of axially extending ridges 42, in FIG. 1, formed on an outer surface of the propulsor shaft 10. These ridges, in a preferred embodiment of the present invention, comprise spline grooves 42 that attach the adapter 40 to the propulsor shaft 10 for rotation in synchrony with each other. The adapter 40 is disposable in coaxial relation with the propulsor shaft 10 about the central axis 12 of rotation, whereby rotation of the propulsor shaft 10 causes synchronous rotation of the adapter 40.

The adapter 40 comprises an outer surface having a first discontinuity formed therein, provided by the ridges 78. The first insert portion 30 comprises an inner surface having a second discontinuity formed therein and defined by a plurality of grooves 74. These first and second discontinuities are shaped to attach the first insert portion 30 to the adapter 40 for rotation in synchrony with the adapter 40. The second insert portion 32 comprises an inner surface having a third discontinuity formed therein and defined by a plurality of grooves 84. The first and third discontinuities are shaped to attach the second insert portion 32 to the adapter 40 in a manner which permits a first predetermined magnitude of relative rotation between the adapter 40 and the second insert portion 32. This first predetermined magnitude of relative rotation is provided by a first space between the first and third discontinuities which allows lost motion to occur between the second insert portion 32 and the adapter 40. This lost motion is provided by the difference in size between the ridges 78 and the grooves 84 which allows relative rotation between the adapter 40 and the second insert portion 32 before the ridges 78 contact the ends of the grooves 84 and transmit torque.

The second insert portion 32 comprises an outer surface 80 which is shaped to be received by an inner surface of the propulsor hub 20 and thereby attach the second insert portion 32 to the propulsor hub 20 for rotation in synchrony with the propulsor hub 20. The first insert portion 30 comprises an outer surface 70 which is shaped to be received an inner opening of the propulsor hub 20 in order to attach the first insert portion 30 to the propulsor hub 20 for rotation in a manner which permits a second predetermined magnitude of relative rotation between the first insert portion 30 and the propulsor hub 20. This second predetermined magnitude of relative rotation is provided by a second space 102 between the outer surface 70 of the first insert portion 30 and an inner surface of the propulsor hub 20 which allows lost motion to occur between the first insert portion 30 and the propulsor hub 20. The third insert portion 34, which comprises the titanium rods 66, is sufficiently resilient to allow a third predetermined magnitude of relative rotation to occur between the first and second insert portions, 30 and 32. The propulsor can be a marine propeller or an impeller used in a pump jet application. The first, second, and third insert portions of the present invention are separable components, as described above, wherein the first and second insert portions, 30 and 32, are each removably attached to the third insert portion 34.

The first insert portion 30 is fitted tight to the adapter 40, but relatively loose in relation to the inner surface of the propulsor hub 20. The second insert portion 32 is fitted relatively loose to the adapter, but tightly to the inner surface of the propulsor hub 20. These relative sizes, along with their function and purpose have been described in greater detail above. In a particularly preferred embodiment of the present invention, the outer surface 70 of the first insert portion 30 moves into high torque transmitting relation with the propulsor hub 20, as described above in conjunction with FIG. 8B at approximately the same time the ridges 78 move to one extreme end of the grooves 84 to transmit high torque between the adapter 40 and the second insert portion 32, as described above in conjunction with FIG. 6C. Both of these contacts between opposing surfaces assist in the transmission of torque between the propulsor shaft 10 and the propulsor hub 20 shown in FIG. 11.

Figure 12:
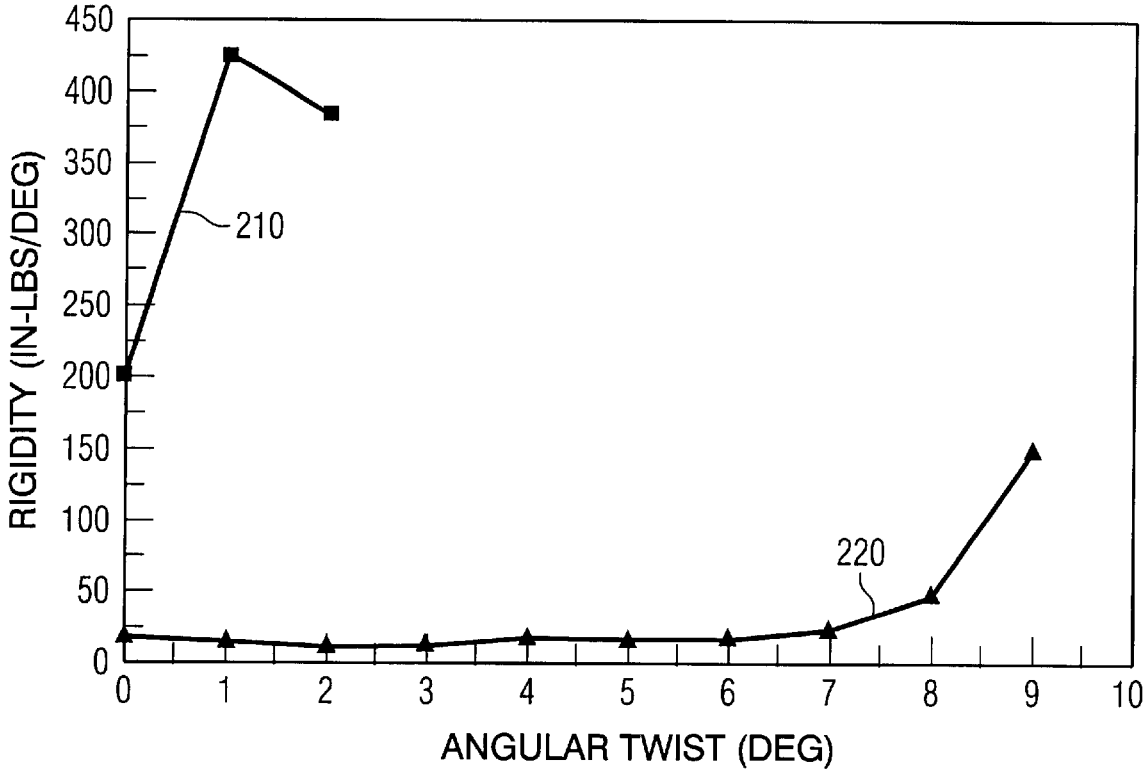
FIG. 12 shows the rigidity, or rate of torque transfer per degree of angular twist, for both the prior art mechanism and a propeller insert made in accordance with the present invention.

FIG. 12 represents the slopes of both lines, 110 and 120, described above in conjunction with FIG. 9. The relationships shown in FIG. 12 are empirical in nature and, therefore, illustrate some discontinuities because of the physical nature of the tests performed to compile the data that is graphically represented in FIG. 12. The slopes of lines 110 and 120 in FIG. 9 are graphically represented by lines 210 and 220, respectively, in FIG. 12. It can be seen that the present invention, as represented by line 220 in FIG. 12, is much less rigid than the prior art propeller insert represented by line 210. This decreased rigidity represents a much higher compliance, particularly at relative angular twists below 8°. This allows relative rotation to occur between the propulsor hub 20 and the propulsor shaft 10 and thereby assuring constant direct metal-to-metal contact between associated components (e.g. clutch, gears) of the torque transmitting shafts, clutches, and gears.

Figure 13:
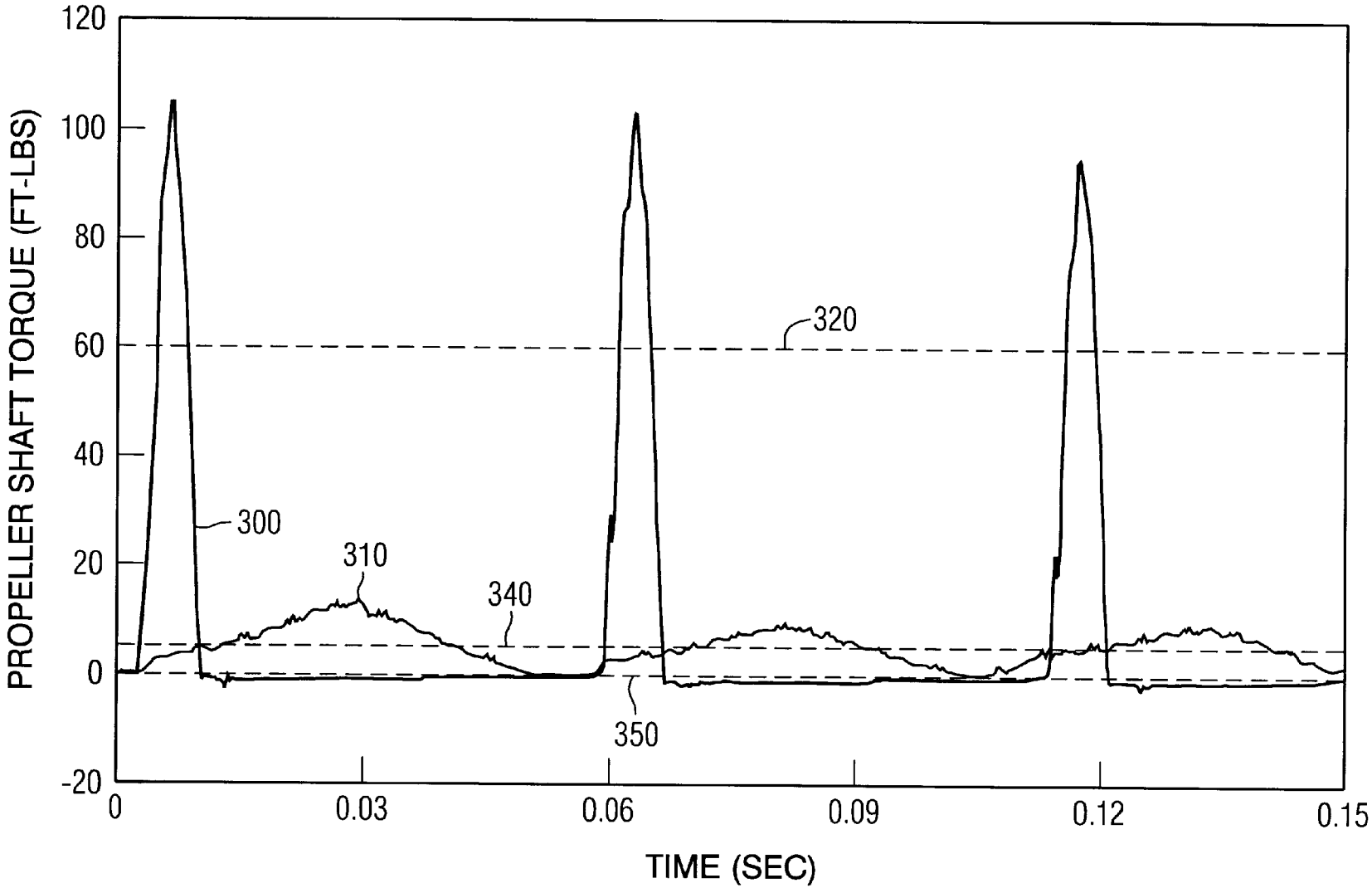
FIG. 13 shows the propeller shaft torque for a prior art propeller hub insert and made in accordance with the present invention.

FIG. 13 is a graphical representation of a short time period showing the magnitudes of propeller shaft torque for a system 300 generally known to those skilled in the art and a system 310 made in accordance with the present invention. Coinciding generally with the firing of individual combustion chambers of an associated engine, it can be seen that significant spikes of torque transfer occur in the prior art system 300. Dashed line 320 represents an approximation of the propeller shaft torque that creates the effect referred to as "prop rattle". As the propeller shaft torque 300 rapidly changes from approximately zero torque to peak values in excess of 100 foot-pounds of torque, the system repeatedly crosses dashed line 320 and creates an audible sound. Because of this rapidly changing torque 300, associated metallic components repeatedly engage and disengage and create the sensation of "prop rattle". Because of the damping effect provided by the present invention and its higher compliance, the propeller shaft torque 310 in a system made in accordance with the present invention is significantly lower and does not exceed 20 foot-pounds of torque at any time. In fact, the mean value of torque magnitude in a system made in accordance with the present invention is represented by dashed line 340 and this magnitude is significantly below dashed line 320 at which prop rattle would be expected to occur. Dashed line 350 represents a zero magnitude of torque.

Although the primary advantages of the present invention relate to the audible sound referred as "prop rattle", it should be understood that other benefits are also provided. For example, the present invention acts as a fuse in the event that a high torque magnitude occurs, such as would be the result of an impact between the propeller blades and a solid object. When this occurs, a high torque impact is experienced by all of the components in the torque transmitting system. Before expensive components can be damaged, the first, second, and third insert portions (reference numerals 30, 32, and 34) would experience fracture and shear and would then allow the propulsor hub 20 to rotate freely with respect to the propulsor shaft 10. By acting as a fuse in the event of a sudden high torque magnitude during an impact situation, the present invention also minimizes expensive damage that could otherwise occur under these circumstances.

Although the present invention has been described in particular detail and illustrated to show a particularly preferred embodiment, it should be understood that alternative embodiments are also within its scope.

We claim:

1. A torque transmitting device for a marine propulsion system, comprising:

an adapter shaped to be attached in torque transmitting relation with a propulsor shaft of said marine propulsion system, said propulsor shaft being rotatable about a central axis of rotation;

a first insert portion shaped to be attached in torque transmitting relation with said adapter;

a second insert portion shaped to be attached in torque transmitting relation with a propulsor hub; and a third insert portion connected between said first and second insert portions, said third insert portion being resilient to allow said first and second insert portions to rotate relative to each other about said central axis of rotation, said adapter being shaped to prevent said first, second, and third insert portions from being compressed in a direction parallel to said central axis of rotation when said adapter is attached to said propulsor shaft.

2. The torque transmitting device of claim 1, wherein:

said adapter comprises an inner opening having a first plurality of axially extending ridges shaped to mesh with a second plurality of axially extending ridges formed on an outer surface of said propulsor shaft, said adapter being disposable in coaxial relation with said propulsor shaft about said central axis of rotation, whereby rotation of said propulsor shaft causes synchronous rotation of said adapter.

3. The torque transmitting device of claim 1, wherein:

said adapter comprises an outer surface having a first discontinuity formed therein, said first insert portion comprising an inner surface having a second discontinuity formed therein, said first and second discontinuities being shaped to attach said first insert portion to said adapter for rotation in synchrony with said adapter.

4. The torque transmitting device of claim 3, wherein:

said second insert portion comprises an inner surface having a third discontinuity formed therein, said first and third discontinuities being shaped to attach said second insert portion to said adapter in a manner which permits a first predetermined magnitude of relative rotation between said adapter and said second insert portion.

5. The torque transmitting device of claim 4, wherein:

said first predetermined magnitude of relative rotation is provided by a first space between said first and third discontinuities which allows lost motion to occur between said second insert portion and said adapter.

6. The torque transmitting device of claim 4, wherein:

said second insert portion comprises an outer surface being shaped to be received by said propulsor hub and attach said second insert portion to said propulsor hub for rotation in synchrony with said hub.

7. The torque transmitting device of claim 6, wherein:

said first insert portion comprises an outer surface being shaped to be received within said propulsor hub in order to attach said first insert portion to said propulsor hub for rotation in a manner which permits a second predetermined magnitude of relative rotation between said first insert portion and said propulsor hub.

8. The torque transmitting device of claim 7, wherein:

said third insert portion is sufficiently resilient to allow a third predetermined magnitude of relative rotation between said first and second insert portions.

9. The torque transmitting device of claim 6, wherein:

said second predetermined magnitude of relative rotation is provided by a second space between said outer surface of said first insert portion and an inner surface of said propulsor hub which allows lost motion to occur between said first insert portion and said propulsor hub.

10. The torque transmitting device of claim 1, wherein:

said third insert portion comprises a plurality of metal rods attached between said first and second insert portions.

11. The torque transmitting device of claim 10, wherein:

said metal rods are titanium.

12. The torque transmitting device of claim 1, wherein:

said propulsor is a marine propeller.

13. The torque transmitting device of claim 1, wherein:

said first, second, and third insert portions are separable components, wherein said first and second insert portions are each removably attached to said third insert portion.

14. The torque transmitting device of claim 1, wherein:

said first, second, and third insert portions combine to provide a torque transfer of less than 150 inch-pounds when said adapter and said propulsor hub experience relative rotation of less than 8.0 degrees and provide a torque transfer of greater than 150 inch-pounds when said adapter and said propulsor hub experience relative rotation of greater than 9.0 degrees.

15. The torque transmitting device of claim 1, wherein:

said first, second, and third insert portions combine to provide a torque transfer rate of less than 75.0 inch-pounds per degree when said adapter and said propulsor hub experience relative rotation of less than 8.0 degrees and provide a torque transfer rate of greater than 100.0 inch-pounds per degree when said adapter and said propulsor hub experience relative rotation of greater than 9.0 degrees.

16. A torque transmitting device for a marine propulsion system, comprising:

an adapter shaped to be attached in torque transmitting relation with a propulsor shaft of said marine propulsion system, said propulsor shaft being rotatable about a central axis of rotation;

a first insert portion shaped to be attached in torque transmitting relation with said adapter;

a second insert portion shaped to be attached in torque transmitting relation with a propulsor hub; and a third insert portion connected between said first and second insert portions, said third insert portion being resilient to allow said first and second insert portions to rotate relative to each other about said central axis of rotation, said first, second, and third insert portions combining to provide a torque transfer of less than 150.0 inch-pounds when said adapter and said propulsor hub experience relative rotation 9.0 degrees or less.

17. The torque transmitting device of claim 16, wherein:

said adapter is shaped to prevent said first, second, and third insert portions from being compressed in a direction parallel to said central axis of rotation when said adapter is attached to said propulsor shaft.

18. The torque transmitting device of claim 17, wherein:

said adapter comprises an inner opening shaped to receive an outer surface of said propulsor shaft in torque transferring relation, said adapter being disposable in coaxial relation with said propulsor shaft about said central axis of rotation, whereby rotation of said propulsor shaft causes synchronous rotation of said adapter.

19. The torque transmitting device of claim 18, wherein:

said adapter comprises an outer surface having a first discontinuity formed therein, said first insert portion comprising an inner surface having a second discontinuity formed therein, said first and second discontinuities being shaped to attach said first insert portion to said adapter for rotation in synchrony with said adapter.

20. The torque transmitting device of claim 19, wherein:

said second insert portion comprises an inner surface having a third discontinuity formed therein, said first and third discontinuities being shaped to attach said second insert portion to said adapter in a manner which permits a first predetermined magnitude of relative rotation between said adapter and said second insert portion.

21. The torque transmitting device of claim 20, wherein:

said second insert portion comprises an outer surface being shaped to be received by said propulsor hub and attach said second insert portion to said propulsor hub for rotation in synchrony with said hub.

22. The torque transmitting device of claim 21, wherein:

said first insert portion comprises an outer surface being shaped to be received within said propulsor hub in order to attach said first insert portion to said propulsor hub for rotation in a manner which permits a second predetermined magnitude of relative rotation between said first insert portion and said propulsor hub.

23. The torque transmitting device of claim 22, wherein:

said third insert portion is sufficiently resilient to allow a third predetermined magnitude of relative rotation between said first and second insert portions.

24. The torque transmitting device of claim 23, wherein:

said first predetermined magnitude of relative rotation is provided by a first space between said first and third discontinuities which allows lost motion to occur between said second insert portion and said adapter.

25. The torque transmitting device of claim 23, wherein:

said second predetermined magnitude of relative rotation is provided by a second space between said outer surface of said first insert portion and an inner surface of said propulsor hub which allows lost motion to occur between said first insert portion and said propulsor hub.

26. The torque transmitting device of claim 23, wherein:

said third insert portion comprises a plurality of metal rods attached between said first and second insert portions.

27. The torque transmitting device of claim 26, wherein:

said metal rods are titanium.

28. The torque transmitting device of claim 16, wherein:

said propulsor is a marine propeller.

29. The torque transmitting device of claim 26, wherein:

said first, second, and third insert portions are separable components, wherein said first and second insert portions are each removably attached to said third insert portion.

30. The torque transmitting device of claim 16, wherein:

said first, second, and third insert portions combine to provide a torque transfer rate of less than 25 inch-pounds per degree when said adapter and said propulsor hub experience relative rotation of less than 6.0 degrees.

31. A torque transmitting device for a propeller of a marine propulsion system, comprising:

an adapter shaped to be attached in torque transmitting relation with a propeller shaft of said marine propulsion system, said propeller shaft being rotatable about a central axis of rotation;

a first insert portion shaped to be attached in torque transmitting relation with said adapter; and a second insert portion shaped to be attached in torque transmitting relation with a propeller hub, said first and second insert portions being rotatable relative to each other, at least one intermediate member connected to both said first and second insert portions providing a first magnitude of torque transfer rate below a first magnitude of relative rotation between said first and second insert portions, said first insert portion and said propeller hub providing a second magnitude of torque transfer rate above a second magnitude of relative rotation between said first and, second insert portions, said second magnitude of relative rotation being greater than said first magnitude of relative rotation.

32. The device of claim 31, wherein:

said first magnitude of torque transfer rate is less than said second magnitude of torque transfer rate, said first and second magnitudes of torque transfer rate being defined as a torque per degree of relative rotation between said first and second insert portions.

33. The device of claim 32, further comprising:

said intermediate member comprising a third insert portion connected between said first and second insert portions, said third insert portion being resilient to allow said first and second insert portions to rotate relative to each other about said central axis of rotation, said adapter being shaped to prevent said first, second, and third insert portions from being compressed in a direction parallel to said central axis of rotation when said adapter is attached to said propeller shaft.

34. The device of claim 33, wherein:

said adapter comprises an inner opening shaped to receive an outer surface of said propeller shaft in torque transferring relation, said adapter being disposable in coaxial relation with said propeller shaft about said central axis of rotation, whereby rotation of said propeller shaft causes synchronous rotation of said adapter, said adapter comprising an outer surface having a first discontinuity formed therein, said first insert portion comprising an inner surface having a second discontinuity formed therein, said first and second discontinuities being shaped to attach said first insert portion to said adapter for rotation in synchrony with said adapter, said second insert portion comprising an inner surface having a third discontinuity formed therein, said first and third discontinuities being shaped to attach said second insert portion to said adapter in a manner which permits a first predetermined magnitude of relative rotation between said adapter and said second insert portion, said second insert portion comprising an outer surface being shaped to be received by said propeller hub and attach said second insert portion to said propeller hub for rotation in synchrony with said hub, said first insert portion comprising an outer surface being shaped to be received within said propeller hub in order to attach said first insert portion to said propeller hub for rotation in a manner which permits a second predetermined magnitude of relative rotation between said first insert portion and said propeller hub, said third insert portion redetermined magnitude of relative portions.

35. The torque transmitting device of claim 34 wherein:

said first, second, and third insert portions are separable components, wherein said first and second insert portions are each removably attached to said third insert portion,said first, second and third insert portions combining to provide said first magnitude of torus transfer rate is 25.0 inch-pounds per degree, said first magnitude of relative rotations is 4.0 degrees, said second magnitude of torque transfer rate is 30.0 inch-pound per degree, and said second magnitude of relative rotation is 6.0 degrees.

* * * * *